United States Patent [19]

Deschenes et al.

[11] Patent Number: 4,998,661

[45] Date of Patent: Mar. 12, 1991

[54] NEEDLE ASSEMBLY FOR FASTENER DISPENSING APPARATUS

[75] Inventors: Charles L. Deschenes, North Attleboro; Donald L. Bourque, Millis; Philip G. Backholm, Northboro, all of Mass.

[73] Assignee: Dennison Manufacturing Company, Framingham, Mass.

[21] Appl. No.: 407,630

[22] Filed: Sep. 15, 1989

[51] Int. Cl.[5] ..... B65C 7/00; A41H 31/00; A43D 69/00

[52] U.S. Cl. ..... 227/67; 227/99; 227/100

[58] Field of Search ..... 227/67, 99, 100

[56] References Cited

U.S. PATENT DOCUMENTS

| | | | |
|---|---|---|---|
| Re. 29,310 | 7/1977 | Bone | 227/67 |
| Re. 29,819 | 10/1978 | Bone | 227/67 |
| 3,470,834 | 10/1969 | Bone | 227/67 X |
| 3,759,435 | 9/1973 | Bone | 227/67 |
| 4,526,310 | 7/1985 | Lundén et al. | 227/67 |
| 4,690,317 | 9/1987 | Hamisch, Jr. et al. | 227/67 |

*Primary Examiner*—Paul A. Bell

*Attorney, Agent, or Firm*—Arthur B. Moore

[57] ABSTRACT

A needle assembly for dispensing plastic fasteners as part of a tool having a feed track through which a fastener assemblage is fed, such needle assembly including the needle which is encased in a holder which may be easily secured to and removed from such tool. The holder defines in conjunction with the remainder of the tool at least a major portion of the feed track. The holder may include an antiback device for permitting the motion of the fastener assemblage within such feed track toward the needle but not in reverse direction. Such antiback device may be engagable by the user to deflect the antiback and a fastener feed mechanism within the tool out of the feed track, thereby to permit withdrawal of a fastener assemblage from the tool. The needle comprises a hollow, slotted metal structure, and the holder is a plastic structure which is injection molded around such needle.

18 Claims, 11 Drawing Sheets

NEEDLE ASSEMBLY FOR FASTENER DISPENSING APPARATUS

This invention relates to the dispensing of plastic attachment members and, more particularly, to the dispensing of attachment members from continuously connected plastic fastener stock.

Techniques for dispensing attachment members from continuously connected fastener stock are disclosed in U.S. Pat. No. 4,121,487, issued Oct. 24, 1978; U.S. Pat. No. 4,039,078, issued Aug. 2, 1977 and U.S. Pat. No. 3,948,128 issued Apr. 6, 1976. In these patents fastener attachment stock is formed by continuously connected plastic side members that are intercoupled by a plurality of cross links. The stock may be produced from flexible plastic materials, such as nylon, polyethylene and polypropylene, by molding or stamping.

Such attachment members can be dispensed to couple buttons to fabric, merchandising tags to articles of commerce, and in the general attachment of one item to another, such as the attachment of tubing to a chassis or electrical wiring to a frame.

In U.S. Pat. Nos. 4,121,487; 4,039,078; and 3,948,128; the stock is severed by relatively movable die members to form individual fastener attachments that are dispensed through one or more hollow slotted needles after appropriate positioning. The fastener stock is fed along a first axis, and an individual attachment severed therefrom by transverse motion of the die members, to move the severed fastener in-line with a hollow needle. The dispensing mechanism is provided by an ejector which forces an end bar portion of the fastener through the bore of the hollow needle during a forward stroke. During the return stroke of the ejector a further individual fastener is moved into position for being dispensed.

Another technique for the dispensing of continuously connected fastener stock is disclosed in U.S. Pat. No. 4,288,017. The fastener stock is engaged by a rotating feed wheel which advances the endmost fastener into the area behind a hollow slotted needle. Here the end bars (T-bars) of the stock, which are dispensed through the bore of the hollow needle, are separated one from the other either during alignment of the end bar with the bore or during the subsequent impact of the ejector with the end bar in the course of driving it through the bore. No moving knife is included, but a stationary knife at the rear of the needle assists separation as the ejector rod pushes the connector against the knife. Any remaining connection of successive fasteners is severed, for example, in the manner illustrated in U.S. Pat. No. 3,733,657.

Conventional needles designed for use in these and other types of attachers include a shank portion which has a relatively sharp tip to permit penetration of the article to be attached and a substantially cylindrical rear portion. The shank is hollow to permit the T-bar end of the attachment to pass therethrough and has a longitudinal slot to permit the filament of the attachment to extend therefrom as the T-bar end moves through the needle. The shank portion extends from a substantially cylindrical base having a central bore with an inner diameter equal to the inner diameter of the hollow shank. The base also has a longitudinal slot aligned with the slot in the shank. In needles which are removable from the attacher, the base is provided with means for correctly positioning the needle within the attacher and means for locking same into place.

Conventional needles of this type are produced commercially in two different ways. The base and shank may be machined from a single piece of metal. While this construction has the advantage of high strength, machining a single piece of metal into the required form is an arduous and time consuming task which results in a relatively expensive product. In order to reduce the cost of the needle, a second construction has been utilized. In this instance, the needle comprises two separate parts, a metal shank portion which is stamped from a flat sheet of metal and thereafter rolled into the desired configuration, and a plastic base part which is molded around the end of the shank portion. This construction results in a needle which is considerably less expensive than the all-metal, single-part construction.

Such needles and the attachers in which they are designed to be used may be categorized according to whether the needle incorporates a knife or a separate knife is provided. Both approaches are shown in U.S. Pat. Nos. 3,470,834; 3,759,435; Re. 29,310, and Re. 29,819, all of which were issued to Arnold R. Bone, which illustrate a number of different manually actuable attachers and needles for use therewith.

It is a principal object of the invention to provide an improved, multifunction needle assembly for use with tag attachers. It is desired to design the needle to facilitate feed of fastener assemblages and severed fasteners through the attacher. Another object is to facilitate the removal of fastener assemblages, and of any jammed fasteners, from the attacher.

BRIEF DESCRIPTION OF THE DRAWINGS

The above and additional aspects of the invention are illustrated in the following detailed description of a preferred embodiment of a fastener dispensing gun, which should be consulted together with the drawings in which.

SUMMARY OF THE INVENTION

Figure 1:
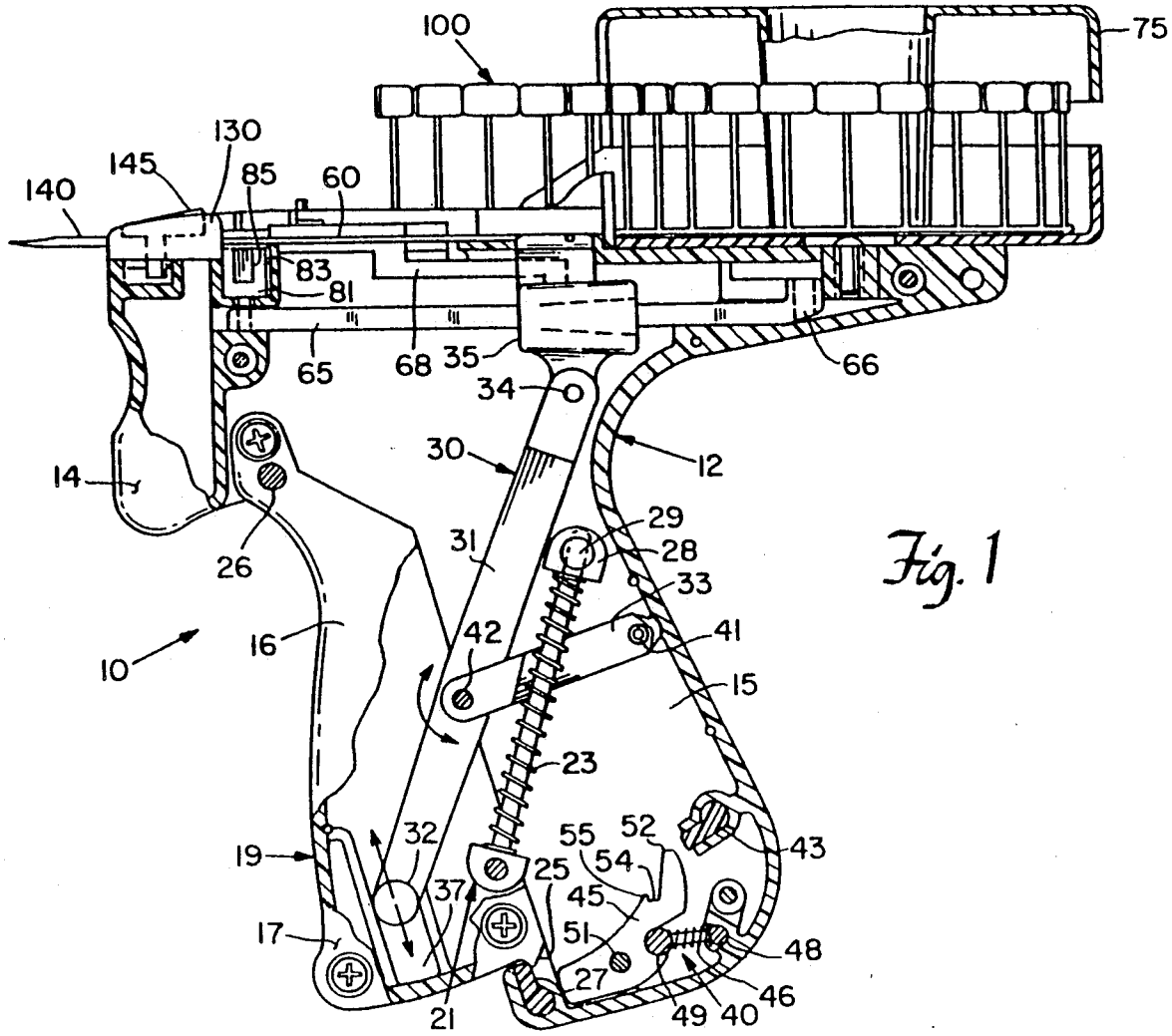
FIG. 1 is an elevation view of the gun as seen from the left side, with most of the left halves of the handle and trigger removed, showing the trigger in its rest position.

The above and additional objects are achieved by the needle assembly of the invention, which is designed for dispensing plastic fasteners as part of a tool having a feed track through which a fastener assemblage is fed to a site at which an individual fastener is separated from the assemblage, to be dispensed through the needle assembly. Such needle assembly comprises a needle encased in a holder which may be easily secured to and removed from said tool, said holder defining in conjunction with the remainder of the tool at least a major portion of the feed track. In the preferred construction of said needle assembly, the needle is a hollow slotted metal structure and the holder is comprised of plastic which is injection molded around said needle.

In the preferred geometry of such needle assembly, the needle holder together with the remainder of the tool define a segment of said feed track which is substantially parallel to the longitudinal axis of said needle. Most preferably, such substantially parallel segment is closely proximate the needle axis. The feed track can include a transverse segment for transfering a separated fastener from the substantially parallel segment to the needle axis.

In the preferred application of such needle assembly, it is designed for dispensing a fastener which is separated from a continuously connected fastener assemblage having an end bar joined to a plurality of transversely oriented, spaced-apart filaments. The feed track is configured to channel the end bar through said tool and to permit the filaments to protrude from said tool.

Advantageously, such needle assembly holder includes a deflectable, resilient antiback member for permitting the travel of the fastener assemblage toward the needle but not in the reverse direction. The holder may be comprised of plastic, and the antiback member comprised of a plastic living hinge integral with said holder. The antiback member may include a saw tooth for engaging the fastener assemblage.

The needle assembly of the invention may include a rotatable locking member which may be inserted into an aperture in said tool and rotated to lock the needle assembly to said tool.

The invention also provides a needle assembly for dispensing plastic fasteners as part of a tool having a feed track through which a fastener assemblage is fed to a site at which an individual fastener is separated from the assemblage to be dispensed through the needle assembly, wherein the needle assembly comprises a needle encased in a holder which may be easily secured to and removed from said tool, said holder including a resilient, deflectable antiback member for permitting the travel of the fastener assemblage toward the needle but not in the reverse direction. In the preferred construction of the invention, the holder is comprised of plastic and the antiback member comprises a plastic living hinge integral with said holder. The antiback member may include a saw tooth for engaging the fastener assemblage.

In an advantageous embodiment of said needle assembly, the tool includes feed means for urging the fastener assemblage toward the separation site, said antiback member being configured so that the user may easily move it out of the feed track, and thereby deflect the feed means out of the feed track. This permits withdrawal of the fastener assemblage from the feed track.

The invention further provides apparatus for separating fasteners from a fastener assemblage and for dispensing plastic fasteners, comprising a tool body, and a needle assemblly which may be easily secured to and removed from said tool body, wherein the needle assembly defines in conjunction with the tool body at least the major portion of a feed track for channeling the fastener assemblage through said tool.

DETAILED DESCRIPTION

With reference to the drawings, an apparatus or gun 10 for dispensing attachment members in accordance with the invention is shown in FIG. 1.

Figure 9:
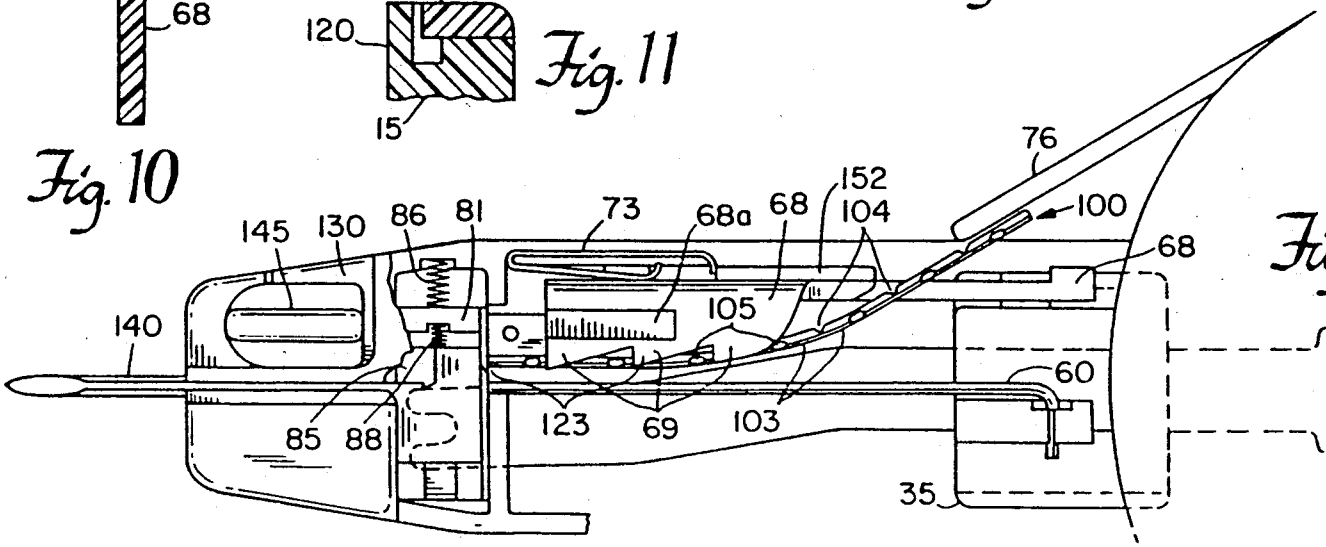
FIG. 9 is a top view of the gun corresponding to FIG. 8, at the level of the fastener feed track.
Figure 13:
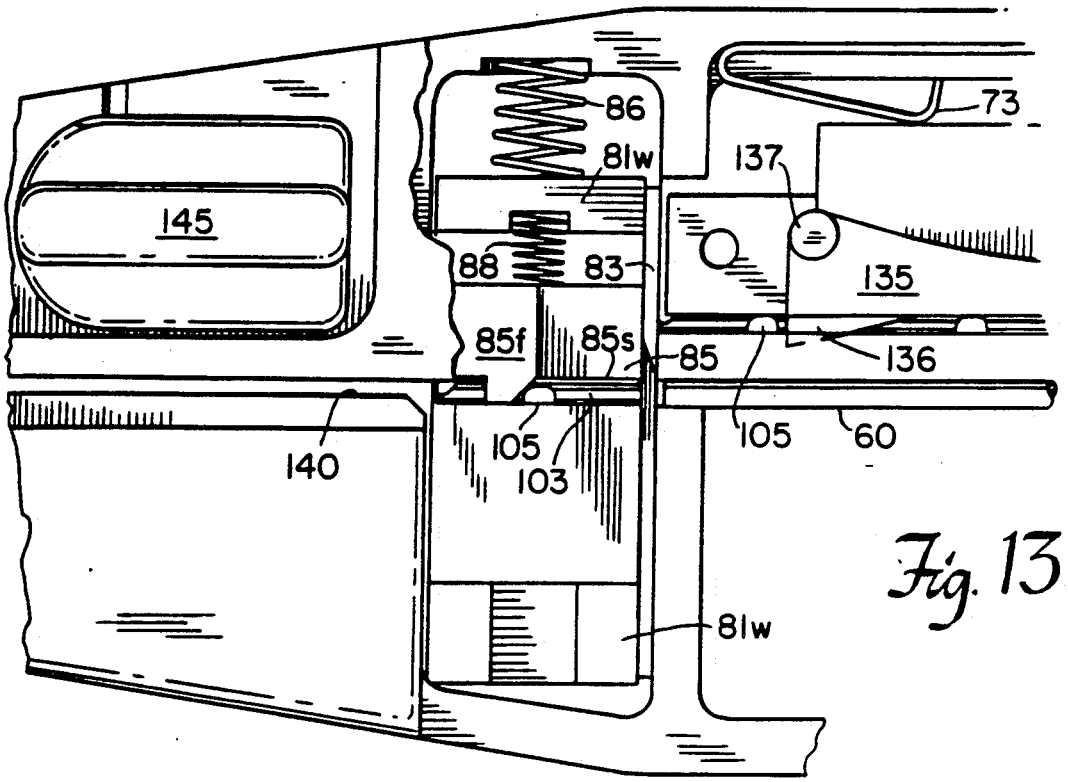
FIG. 13 is a top sectional view of the shuttle assembly and adjacent structures, showing the fastener slide advanced to move a second fastener in-line with the needle bore.

The fasteners are advantageously of the continuously connected type shown in U.S. Pat. No. 4,288,017 which issued Sept. 8, 1981. As shown in FIG. 1 hereof, each individual fastener 101 includes a filament 105 which extends between a head member or paddle 107 and an opposite end member or T-bar 103. The heads and opposite ends of successive fasteners are joined by severable connectors to form continuously connected fastener stock. Thus, as seen in FIGS. 9, 13 which show the fastener stock 100 in section, the T-bars 103 are joined by severable connectors 104. These connectors are severed within the tool 10 using the apparatus of the invention, discussed below. The connections between successive paddles 107 is severed after an individual fastener has been ejected from the tool, as explained below.

Referring again to FIG. 1, the gun is formed by a hollow casing or handle assembly 12, and is hand actuated by a trigger 16. The casing is preferably in two halves, a left handle 14 and right handle 15, which may be joined together in conventional fashion using, for example, screw fasteners, and fabricated from any convenient material, such as molded plastic. Similarly, the trigger 16 may consist of left half 17 and right half 19. Various features within the handle 12 and trigger 16 may consist of dual structures within the respective body halves, but the following discussion refers only to single structures for the sake of simplicity. In FIG. 1, the left handle 14 is removed for clarity. Trigger assembly 16 is held biased against the handle assembly 12 by a compression spring 23 which reacts against spring post 28. The trigger rotates about pivots 26 in the handle assembly. Motion is restricted in the open position (as shown in FIG. 1) by the engagement between a stop tab 25 located on the trigger and a bumper 27 housed in the handle. The spring post 28 reacts against and rotates in a pivot 29 in the handle assembly. The trigger assembly houses a spring retainer 21 pivottably mounted between the trigger halves.

A drive link assembly 30 connects the trigger 16 to an actuator slide 35, which in turn drives various major functional assemblies of gun 10 as explained below. The drive link assembly 30 is comprised of drive link 31, idler link 33, the actuator slide 35 and two pivot pins 34 and 42. A boss 32 travels in a slot 37 in the trigger and transmits trigger motion to the drive link assembly 30 as the trigger 16 is rotated about pivot 26. The drive link 31 is attached to actuator slide 35 by the pivot pin 34. The idler link 33 rotates between drive link 31 (to which it is pivotallY connected by pin 42) and a pivot 41 in the handle assembly. This produces lost motion of the upper end of drive link 31, during linear motion of the actuator slide 35. The rearward motion of trigger 16 is limited by bumper 43. This drive link arrangement maintains mechanical advantage and provides a linear force profile, as the trigger 16 is depressed.

Figure 2:
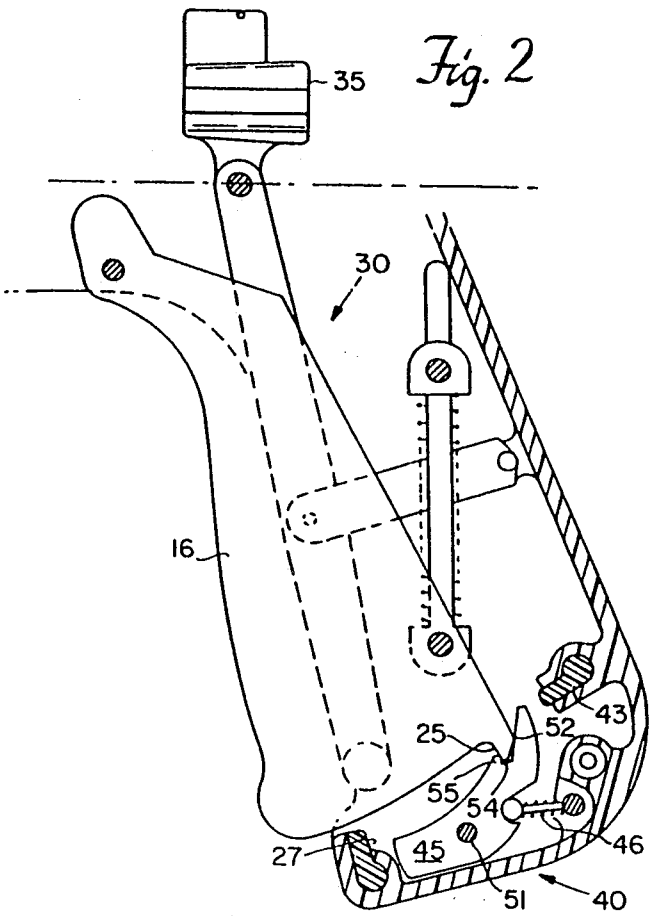
FIG. 2 is an elevation view of the lower part of the gun casing with the left half removed, showing the trigger engaged by the catch lever.
Figure 3:
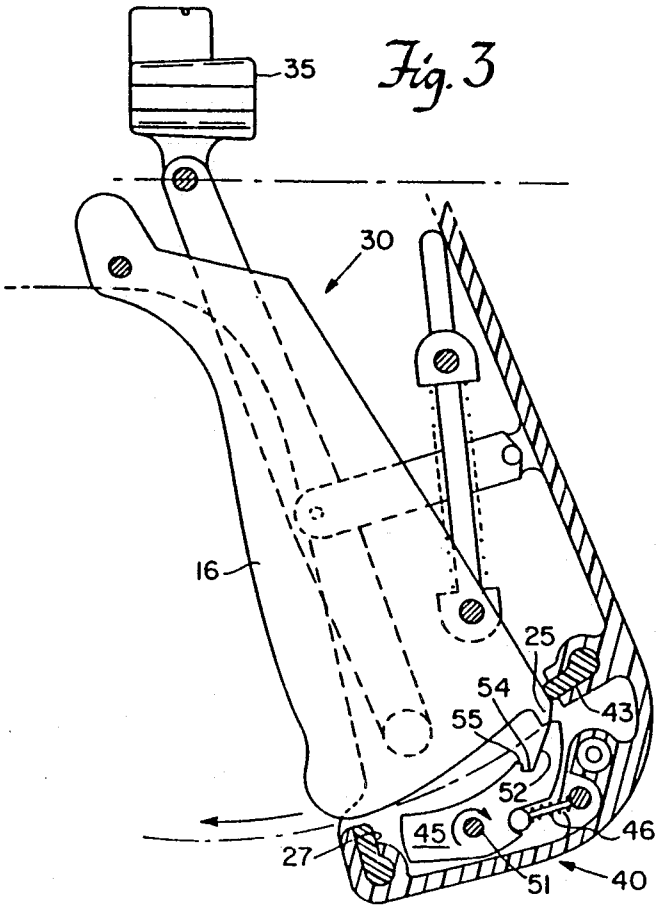
FIG. 3 is an elevation view corresponding to FIG. 2, showing the trigger fully depressed.

Trigger antiback assembly 40 controls the motion of trigger 16, with operational advantages explained below. Trigger antiback assembly 40 includes a catch lever 45 pivotally mounted within the handle at pin 51. Lever 45 is biased toward its position shown in FIG. 1 by virtue of the over-center mounting of a compression spring 46 between a spring retainer 48 and spring pivot 49. When the trigger 16 is depressed, the catch lever 45 is cammed over-center by the action of stop tab 25 against cam surface 52. If the trigger is not fully depressed, but has rotated beyond the position at which stop tab 25 rides over locking tab 55, stop tab 25 will be engaged in the cavity 54 preventing return rotation of the trigger 16. (See FIG. 2). As will become more evident in the further explanation of the fastener feed mechanisms, this locking or antiback action occurs at the point at which the feed of the fastener stock 100 has begun. Trigger 16 must then be completely rotated to its rearward position to cam the catch lever 45 into the position shown in FIG. 3 and thereby clear the lever 45 out of the way to permit return rotation of the trigger 16.

Figure 4:
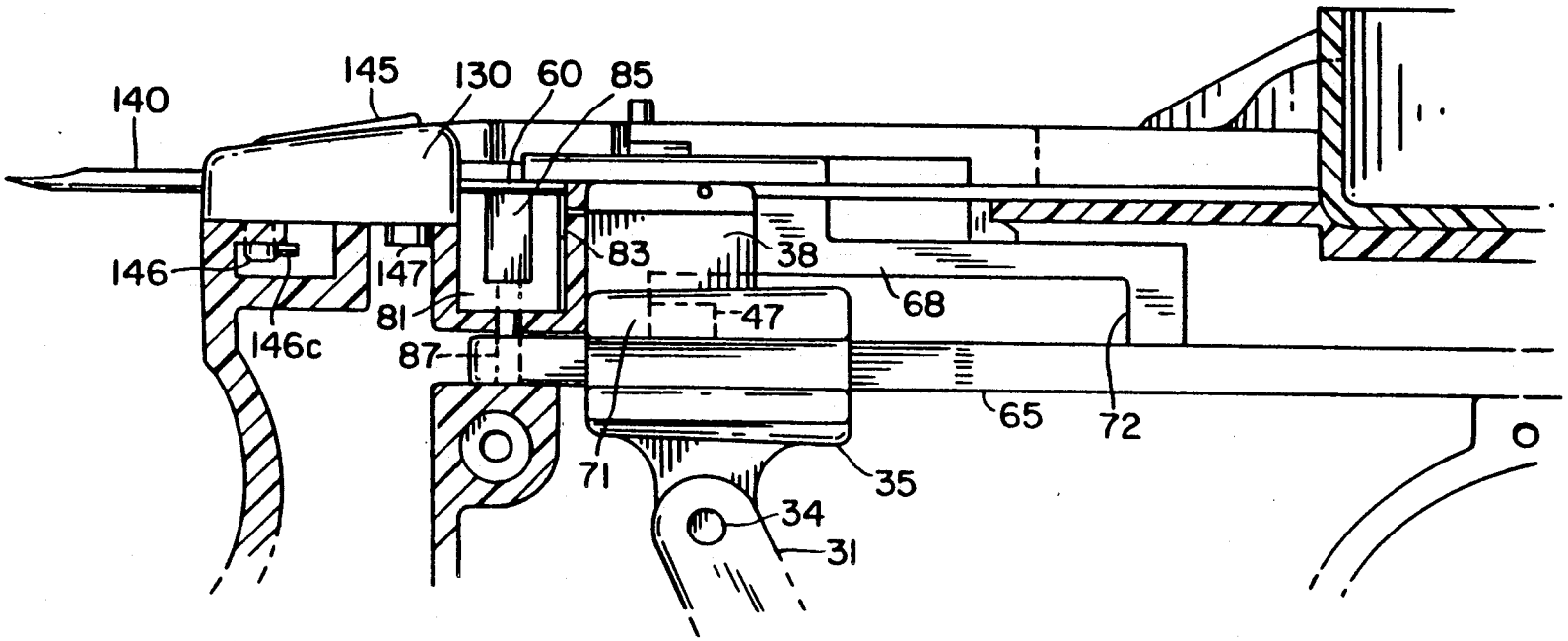
FIG. 4 is a partial elevation view of the upper part of the gun as seen from the left side with the left half removed, showing the actuator slide at its forwardmost position.
Figure 5:
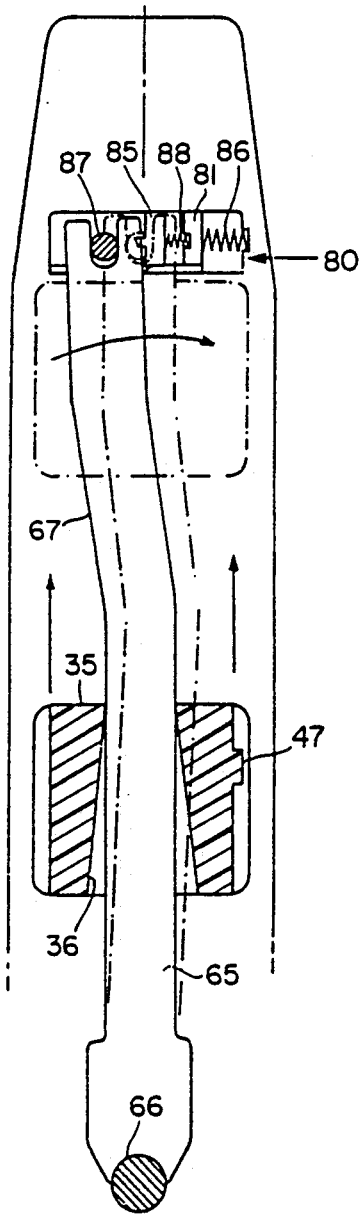
FIG. 5 is a partial sectional view of the gun from above, showing the cam bar and related mechanisms.
Figure 6:
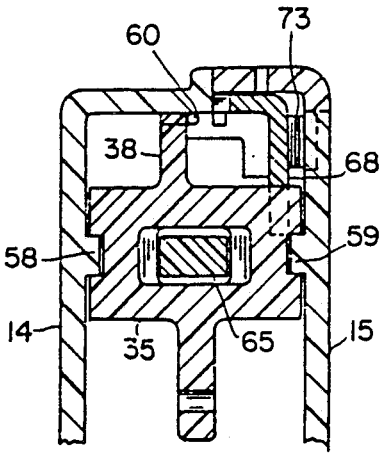
FIG. 6 is a rear sectional view of the upper part of the gun, in a section through the actuator slide.

As seen in FIGS. 4–6, the actuator slide 35 moves along a linear path, sliding between tracks 58 and 59 in the handle halves 14 and 15.

Actuator slide 35 serves three functions in gun 10:

(1) To eject a fastener through needle 140 by advancing an ejector rod 60;

(2) To actuate the feed finger advance 68 which feeds the fastener stock 100 to a shuttle assembly 80; and (3) To provide motion to the cam bar 65 which in turn reciprocates shuttle assembly 80. This linear shuttle motion comprises distinct motions of a knife slide 81, knife 83, and fastener slide 85, as explained below.

Having reference to FIGS. 4, 6, the actuator slide 35 includes an upright support 38 to which the ejection rod 60 is secured at its upper end. Thus, the forward stroke of the actuator slide 35 causes the forwawrd motion of the ejector rod 60 through needle 140.

As seen from above (FIGS. 9,13), the feed finger advance 68 includes a series of saw teeth 69 which urge the fastener stock 100 forward during the forward motion of feed finger advance 68, but permit the feed finger 68 to slide over the fastener filaments 105 during the rearward motion of this structure thereby to engage a successive fastener. Feed finger advance 68 is biased toward the fastener stock 100 by leaf spring 73. As seen in FIG. 4 the feed finger advance 68 has a pair of depending legs 71, 72; note also the rear sectional view of this structure in FIG. 6. The actuator slide 35 has a protuberance 47 (FIGS. 4, 5) which abuts against the legs 71, 72 as the actuator slide 35 approaches its forward and rearward extremes of travel, respectively. By this means, the feed finger advance 68 advances the fastener chain 100 over the pitch of one fastener during each actuation of the trigger 16, in particular as the trigger reaches and moves past the position shown in FIG. 2. By the same means, the feed finger advance 68 is retracted on the rearward stroke of the actuator slide 35 (return rotation of trigger 16) to engage the next fastener in chain 100.

As best seen in FIG. 6, actuator slide 35 slides within two tracks 58, 59 in handle halves 14, 15. Tracks 58, 59 define a linear path. As seen in FIG. 5, a cam bar 65 is pivotally mounted at the rear of tool 10, at 66, and fits within a tapered cavity 36 in actuator slide 35. The forward or rearward motion of actuator slide 35 results in lateral motion of the front of cam bar 65 when the actuator slide engages the inclined cam region 67 causing a slight swinging of the cam. This in turn causes lateral motion of the mechanisms of shuttle assembly 80 as discussed below. This arrangement positively drives the shuttle motion in both directions.

Figure 11:
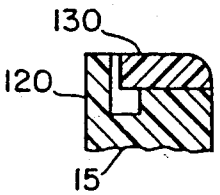
FIG. 11 is a sectional view of the fastener feed track at the section 11—11 of FIG. 8.

Continuously connected fastener stock 100 is fed from a suitable supply, such as the supply spool 75 shown in FIG. 1. Referring to the top views of FIGS. 8, 9, the fastener stock 100 passes from the supply assembly 75 into feed track 120 at the top of the tool, so that the interconnected T-bars 103 of the fasteners are firmly engaged within the track (FIG. 9) while the filaments 105 and paddles 107 project from the top of the tool. One of the particularly novel aspects of this tool design is the incorporation of a needle assembly 130 which cooperates with a mating portion of the tool body to define the fastener track. As shown in FIG. 11, which is a section taken at 11—11 in FIG. 8 at the entry region of the feed track 120, needle assembly 130 mates with right handle 15 to define the feed track 120.

Figure 8:
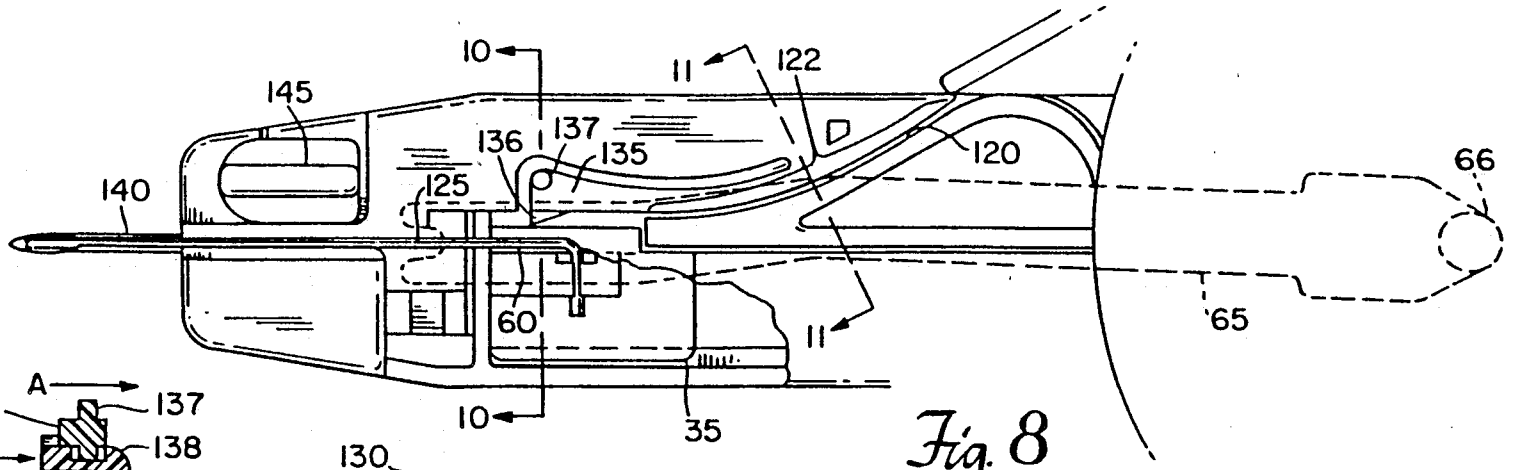
FIG. 8 is a top view of the gun, with part of the casing removed to display mechanisms at the left half of the gun.
Figure 10:
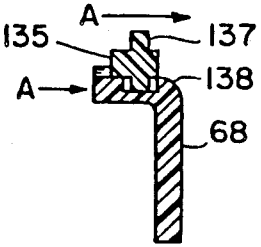
FIG. 10 is a sectional view of the fastener antiback device of the needle assembly at the Section 10—10 of FIG. 8.
Figure 12:
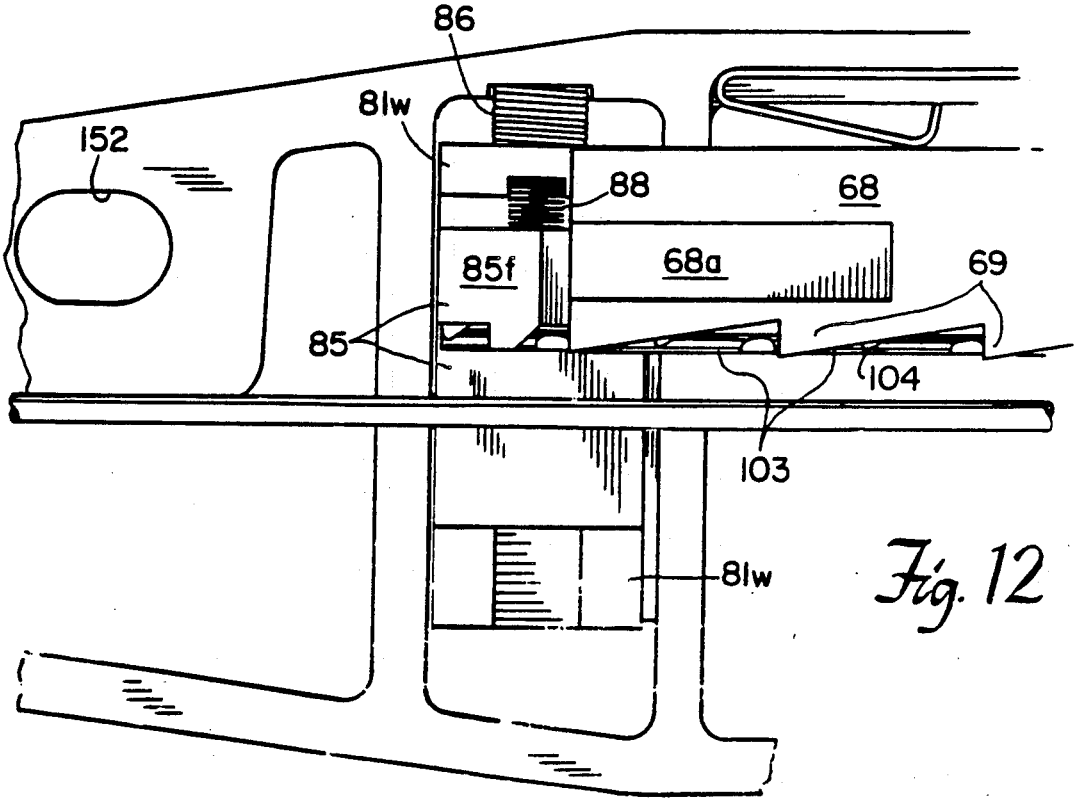
FIG. 12 is a top sectional view of the shuttle assembly and adjacent mechanisms including the feed finger advance, showing the fastener stock fed advanced into the shuttle prior to severing of a fastener.
Figure 14:
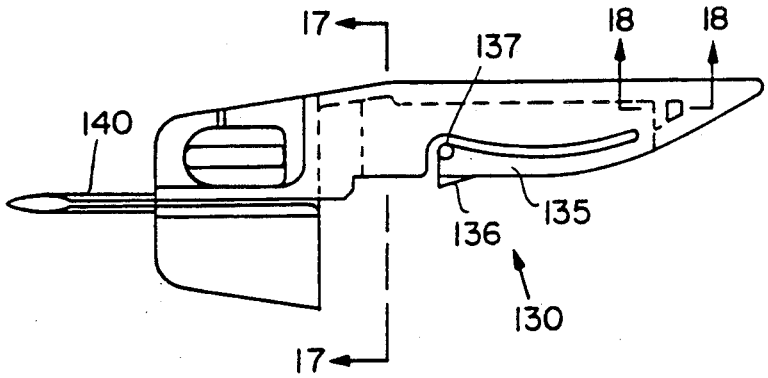
FIG. 14 is a top plan view of the needle assembly.
Figure 15:
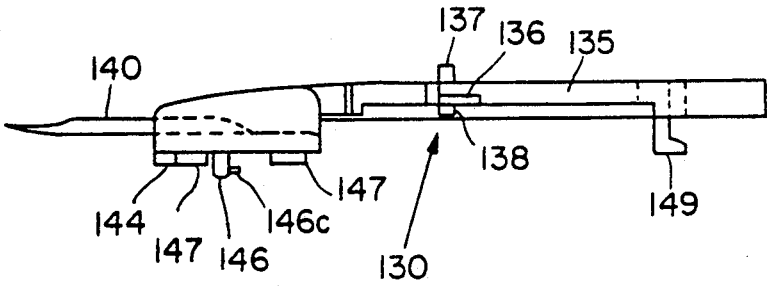
FIG. 15 shows the needle assembly from the left side.
Figure 16:
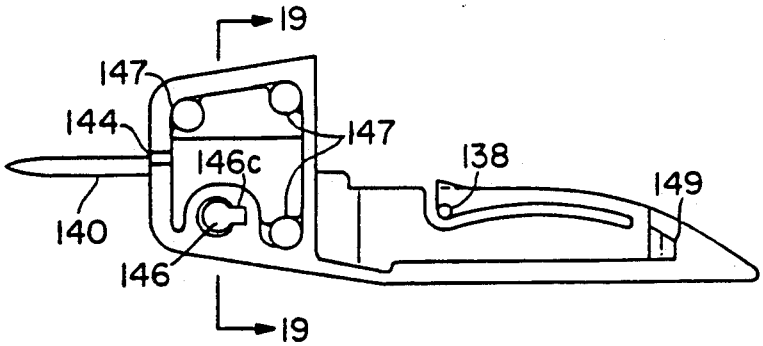
FIG. 16 is a bottom view of the needle assembly.

The needle assembly 130 incorporates an antiback mechanism 135 which prevents the fastener stock 100 from backing out of the feed track 120 during operation. As shown in FIG. 8 and the isolated views of the needle assembly in FIGS. 14, 16, the antiback mechanism 135 comprises a living hinge, i.e. a flexible finger integral with the needle assembly 130 and having a saw tooth 136 which engages the fastener filaments 105. Because of the mild slope of its leading edge the antiback tooth 136 permits the fastener to advance while the antiback 135 deflects out of the fastener path; the tooth 136 has an abrupt rear surface to prevent the retrograde motion of a fastener which has moved past it. As seen in FIG. 10 which is a section taken at 10—10 in FIG. 8, antiback 135 includes a pin 137 which permits the operator to deflect the antiback 135 in the direction indicated by arrow A, and a second pin 138 which forces the feed finger advance 68 out of the fastener track; the operator may then unload the chain of fasteners from the track 120. The lower pin 138 fits within a slot 68*a* in the feed finger advance (FIGS. 9, 12).

Thus, the needle assembly 130 contains not only the needle—the means by which a fastener is inserted into an article to be marked—but also defines the fastener feed track, contains the fastener antiback mechanism, and provides the release mechanism which permits unloading the fastener stock from the tool. Other features of the needle assembly, and its manufacture, are discussed below.

A portion 123 of the fastener track 120 on either side of the antiback 135 is essentially straight and parallel to the ejection axis, that of the needle 140 and ejector rod 60. This feed track segment 123 leads up to the transfer section 125 of the feed track at which shuttle assembly 80 severs an individual fastener from fastener stock 100, and moves the fastener laterally to the ejection axis.

Figure 7:
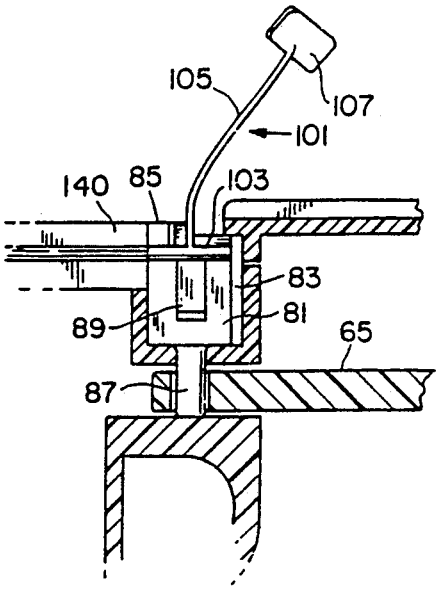
FIG. 7 is a sectional view from the left side of the shuttle assembly and cam bar, in a section taken in the plane of the needle bore, showing a fastener aligned with the needle.

Referring to FIG. 7, the knife slide 81 acts as the main shuttle mechanism which carries the knife 83 and fastener slide 85 during the operation of the tool. As seen in FIGS. 5, 13, a compression spring 86 biases the knife slide 81 toward the left handle. Knife slide 81 includes a boss or cam yoke 87 which connects it to cam bar 65 and transmits the lateral motion of the cam to the knife slide. As seen in FIGS. 7, 13 the knife 83 is fixed to knife slide 81 to move therewith. The fastener slide 85 is retained by knife slide 81 by means of a tongue and groove mechanism 89. It is free to slide in parallel with the knife slide between upstanding walls 81w of the knife slide. Fastener slide 85 is held biased toward the left side of the knife slide by compression spring 88. Thus, the main compression spring 86 biases the entire shuttle assembly to the left side, while the secondary spring 88, which has a lower spring constant than spring 86, only biases the fastener slide 85. By this arrangement, the fastener slide serves as a secondary shuttle which yields when it meets interference with a fastener to compress the spring 88 (FIG. 12). This motion of the fastener shuttle exposes the cutting surface of knife 83 to the fastener stock, and the fastener slide 85 allows the knife slide 81 further motion to the right until the knife cuts the fastener at the thin connector 104. Thereupon, spring 88 returns the fastener slide 85 to its home position and forces the severed fastener against the exit slot of needle 140 (FIG. 13), after the plunger 60 withdraws to the rear. An elevated portion at the right side of fastener slide 85 defines a wall surface 85*s* for engaging T-bar, while a further elevated finger 85*f* engages the filament 105 (FIG. 13). The system is calibrated to continue to maintain pressure on the fastener against the wall of the needle entry.

Applicants have observed that a straight shearing of the T-bar section of continuously connected fastener stock requires an unduly high force. They have discovered that by putting a thin, sharp knife alongside a yieldable transfer mechanism, and cutting the fastener stock just as the transfer action commences, the cutting force required is markedly reduced. In the shuttle assembly 80, the transfer mechanism is a reciprocating slide, but alternatively the transfer device could be an oscillating rotor which is biased clockwise or counter clockwise. The transfer slide or rotor, or at least a portion thereof which is adjacent the knife, is yieldable so that the T-bar section can deflect as the knife is cutting. By allowing this deflection, the knife can make a clean square cut with a relatively small force, and the T-bar section will be returned to its original straight configuration once the cut is completed. The feed track and ejection track preferably should be parallel to each other and in close proximity (illustratively, on the order of 3 millimeters). A transfer device designed as described above can simultaneously cut an individual "T" bar and transfer it in line with the ejection track.

The transfer mechanism described above requires a straight line motion for severing and transferring an individual fastener. In the manual tool of the preferred embodiment, the shuttle is spring biased toward the left side, to provide the force for cutting the fastener. This biasing also allows the shuttle assembly 80 to properly interface with the cam bar 65. Although the illustrated tool depends on a spring force to urge the knife slide 81 toward the ejection axis, it is also feasible to rely on an electrically or fluidically powered mechanism to positively drive the knife slide.

Reference should now be had to FIGS. 14–23 which which illustrate the preferred construction of a needle assembly 130 for use with the tool 10. As seen in the side view of FIG. 15 and bottom view of FIG. 16, needle assembly 140 includes three downwardly protruding posts 147 and a rib 144 at the front of the assembly, and a locking tab 149 toward the rear of the assembly. (See also FIG. 18 which shows a sectional view of the locking tab 149). Referring to FIG. 1 as well as FIGS. 14 and 16, the needle assembly 140 also includes a downward keyhole-shaped projection 146 which may be rotated by the operator by means of a needle lock knob 145. Locking tab 149 and projection 146 are designed to fit into apertures 151 (FIG. 12), 152 (FIG. 9), in the right half of the tool body while posts 147 and rib 144 support the needle assembly against walls of the tool body. To insert a replacement needle assembly into the tool, the operator inserts locking tab 149 into a slot opening in the handle half 15, and exerts slight backward pressure while seating the front part of the needle assembly in place. The user then rotates needle lock knob 145 a half turn to lock the needle assembly in place due to the mating of the cam surface 146c of projection 146 with an aperture within the tool body.

Figure 17:
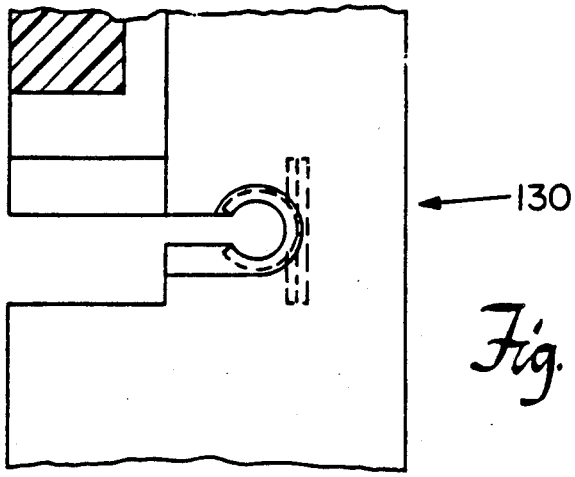
FIG. 17 is a sectional view of the needle assembly in the section 17—17 of FIG. 16.
Figure 18:
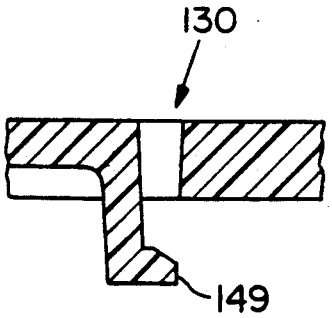
FIG. 18 is a partial sectional view of the needle assembly in the section 18—18 of FIG. 14.

As explained above, needle assembly 130 is configured to define the fastener feed track 120 in conjunction with the tool body (FIG. 11). The needle assembly 140 is shaped to provide an arcuate entry feed path 122 (FIG. 8) followed by a straight path 123 parallel to the ejection axis, and a short, transversely oriented transfer path 125 (FIG. 8) leading up to the entry region of the needle. FIG. 17 shows the entry region of the needle assembly 140 as seen from the rear.

Figure 19:
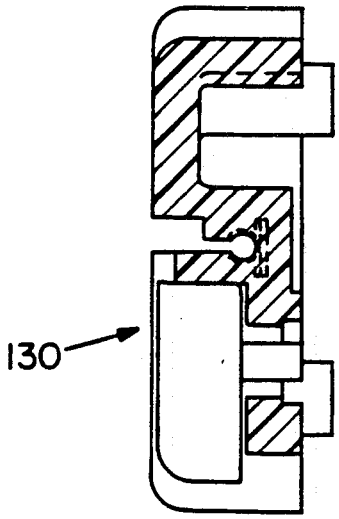
FIG. 19 is a sectional view of the needle in the section 19—19 of FIG. 16.
Figure 23:
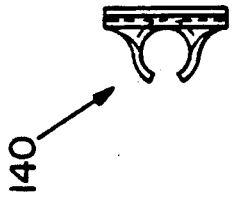
FIG. 23 is a rear view of the needle.
Figure 22:
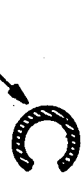
FIG. 22 is a sectional view of the needle shank in the section 22—22 of FIG. 20.
Figure 20:
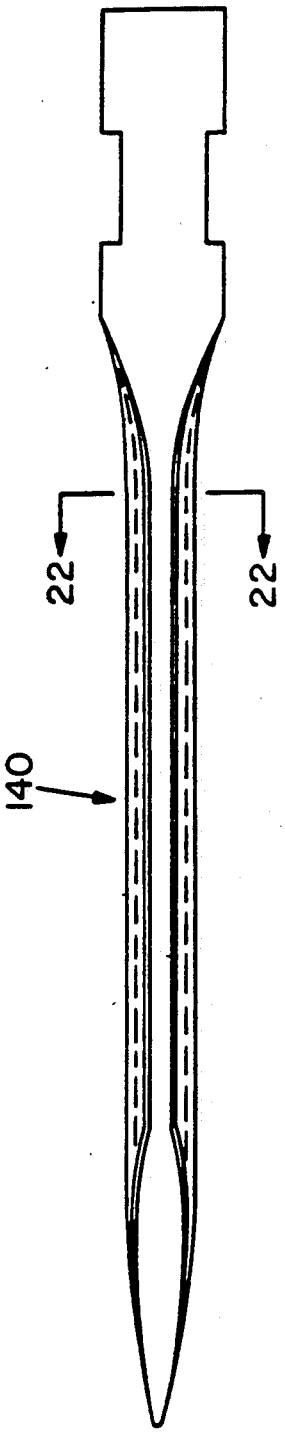
FIG. 20 is a top view of the metal needle.
Figure 21:
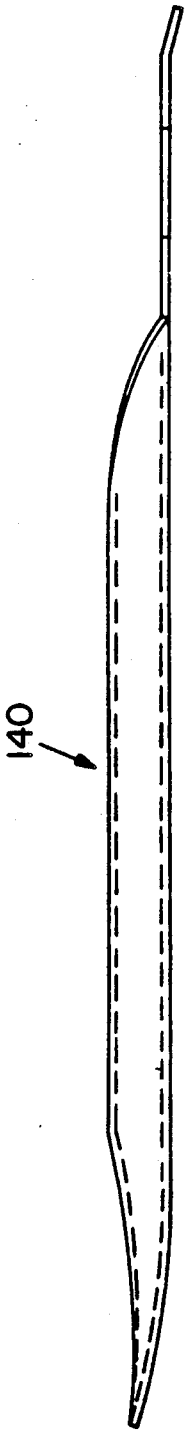
FIG. 21 is a side view of the needle.
Figure 24:
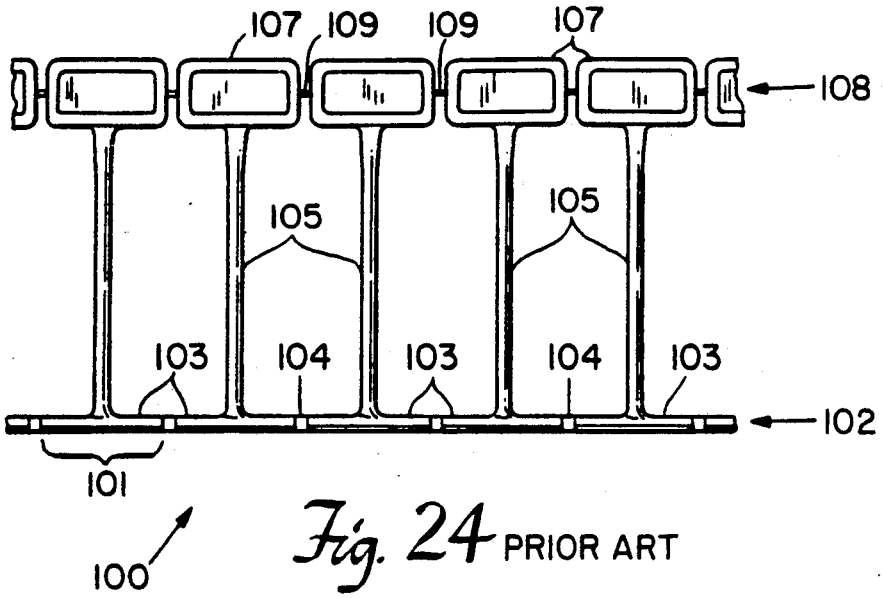
Fig. 24 PRIOR ART
Figure 25:
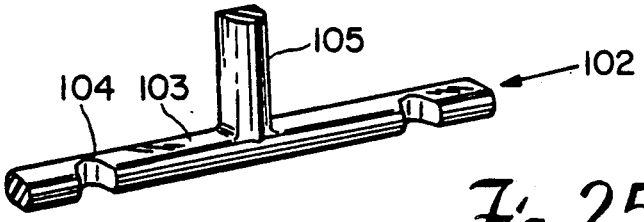
Fig. 25 PRIOR ART
Figure 26:
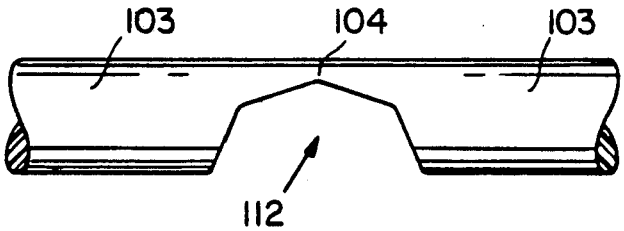
Fig. 26 PRIOR ART
Figure 27:
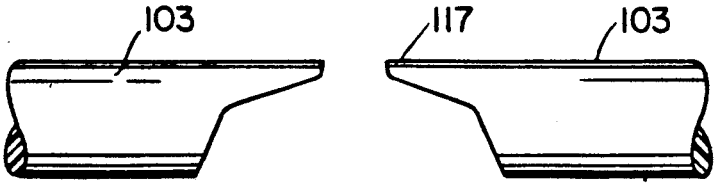
Fig. 27 PRIOR ART
Figure 28:
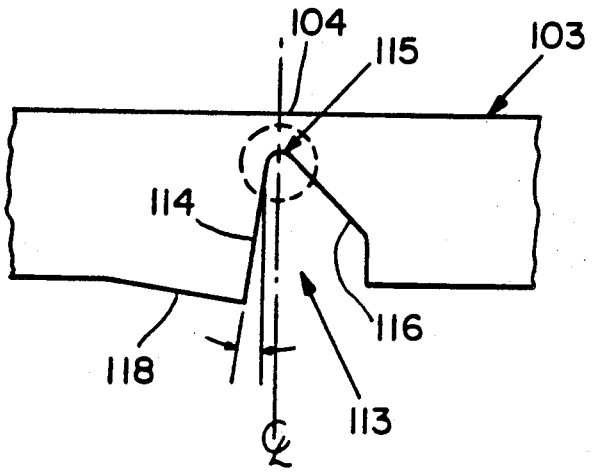
Figure 30:
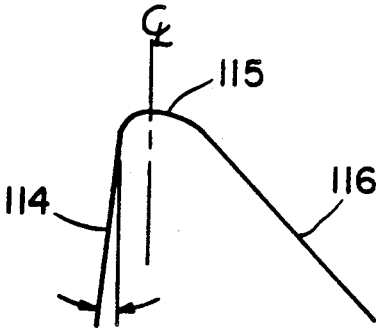
Figure 29:
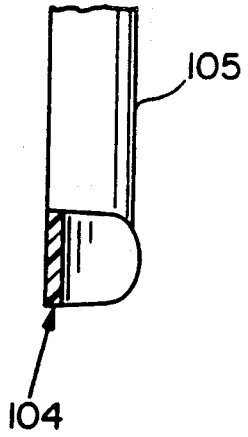

FIGS. 20–23 provide various views of the hollow, slotted metal needle 140 from the needle assembly 130. Advantageously, the needle 140 is stamped and rolled into the configuration shown, as known in the prior art. The remainder of the needle assembly is then formed of a thermoplastic material such as nylon, which is injection molded around the metal needle 140. FIG. 19 shows a sectional view of the needle assembly taken at section 19—19 in FIG. 16, in a transverse section through the needle lock.

The sequence of operation of tool 10 is as follows. When the tool is in its relaxed configuration (FIG. 1), a completely severed fastener 101 is loaded into the needle 140 for ejection. A tag is placed over the needle 140 and the needle inserted through the article to be marked. Trigger 16 is then squeezed and the drive linkage is actuated as explained above. Actuator slide 35 begins to advance and carries ejector rod 60 into the back end of the T-bar 103 of fastener 101 (FIG. 13). Continued motion of the mechanism causes the fastener T-bar to be loaded into the bore of hollow needle 140. Further motion causes T-bar 103 to continue to travel down the bore of hollow 140, and begins the motion of knife slide 81. The actuator slide 35 interacts with the cam bar 65 as explained above to impart a slight rotational motion to the cam. This causes the front end of the cam to move to the right, carrying with it the knife slide 81 by means of the boss 87. Thus, the fastener slide 85 and knife 83 are also displaced to a point at which the shuttle is aligned with the feed track 120 (FIG. 12).

Continued motion of the actuator slide begins actuation of the feed finger advance 68. At this point in the cycle, the trigger antiback 45 is actuated and the trigger assembly cannot be released until the tool has completed its cycle. Feed finger advance 68 begins pushing on filament 105 of the fastener until it is indexed one complete pitch of the fastener chain, loading the connected chain into the shuttle mechanism, and indexing the next fastener in line beyond the antiback portion 135 of needle assembly 130. During this time, ejector rod 60 completes ejection of the fastener 101 through hollow needle 140, the tags, and the article to be marked, completing the forward cycling of the tool, and clearing the trigger antiback 45.

The tool may be removed from the goods now marked with the trigger still completely squeezed; by releasing the trigger prior to withdrawal of the tool from the goods; or while releasing the trigger simultaneously with withdrawing the needle from the goods. As the needle is withdrawn from the article to be marked, the T-bar 103 will resiliently resume its transverse orientation with respect to filament 105. This will prevent withdrawal of the filament from the material. Motion of tool 10 as it is removed from the article will break the connection between the paddle 107 of the ejected fastener and the paddle of the next fastener, in the manner illustrated in U.S. Pat. No. 3,733,657.

Releasing of trigger assembly 16 causes the following events to occur;

The ejector rod 60 begins to withdraw from needle 140 as actuator slide 35 moves back with the tool. Continued rearward motion of actuator slide 35 commences the movement of shuttle assembly 80 by rotating the cam bar 65 which urges the boss 87 of knife slide 81 to the left. As the knife slide 81 moves to the left, the fastener stock 100 arrests the motion of the fastener slide 85 by compression spring 88 and begins to expose the knife 83. Full exposure of knife 83 to the fastener stock severs the end most fastener 101 from the remainder of the fastener stock 100. The cut fastener is then pushed to the left side of the tool by the compression spring 88 into contact with the ejector rod 60 which is continuing to withdraw from the needle assembly 130. Continued return motion of trigger 16 withdraws ejector rod 60 from the shuttle section of tool 10 and begins to withdraw the feed finger advance 68 to a point beyond fastener antiback 135. Completion of the rearward stroke of actuator ejector **40*d*** from the shuttle section allowing the ejection position in preparation for a subsequent actuation of the tool.

I claim:

1. A needle assembly for dispensing plastic fasteners as part of a tool having a feed track through which a fastener assemblage is fed to a site at which an individual fastener is separated from the assemblage, to be dispensed through the needle assembly, said needle assembly comprising a needle permanently encased in a holder which may be easily secured to and removed from said tool, said holder defining in conjunction with the remainder of the tool at least a major portion of the feed track, wherein said needle assembly comprises a replaceable part of said tool.

2. A needle assembly as defined in claim 1 wherein the needle is a hollow, slotted -metal structure and the holder is plastic which is injection molded around said needle.

3. A needle assembly as defined in claim 1 wherein said holder together with the remainder of said tool defines a segment of said feed track which is substantially parallel to the longitudinal axis of said needle.

4. A needle assembly as defined in claim 3 wherein the substantially parallel segment is closely proximate the needle axis.

5. A needle assembly as defined in claim 3 wherein the feed track includes a transverse segment for transferring a separated fastener from the substantially parallel segment to the needle axis.

6. A needle assembly as defined in claim 1, for dispensing a fastener separated from a continuously connected fastener assemblage having an end bar formed to a plurality of transversely oriented, spaced apart filaments, wherein the feed track is configured to channel the end bar through said tool and to permit the filaments to protrude from said tool.

7. A needle assembly as defined in claim 1 wherein said holder includes a deflectable, resilient antiback member of permitting the travel of the fastener assemblage toward the needle but not in the reverse direction.

8. A needle assembly as defined in claim 7 wherein the holder is comprised of plastic, and the antiback member comprises a plastic living hinge integral with said holder.

9. A needle assembly as defined in claim 7 wherein the antiback member carries a saw tooth for engaging the fastener assemblage.

10. A needle assembly as defined in claim 1 further comprising a rotatable locking member which may be inserted into an aperture in said tool and rotated to lock the needle assembly to said tool.

11. A needle assembly for dispensing plastic fasteners as part of a tool having a feed track through which a fastener assemblage is fed to a site at which an individual fastener is separated from the assemblage, to be dispersed through the needle assembly, said needle assembly comprising a needle having an internal bore and a longitudinal slot, encased in a holder which may be easily secured to and removed from said tool, said holder including a resilient, deflectable antiback member for permitting the travel of the fastener assemblage toward the needle but not in the reverse direction.

12. A needle assembly as defined in claim 11 wherein the holder is comprised of plastic, and the antiback member comprises a plastic living hinge integral with said holder.

13. A needle assembly as defined in claim 11 wherein the antiback member comprises a saw tooth for engaging the fastener assemblage to permit such unidirectional motion.

14. A needle assembly as defined in claim 11 wherein the tool includes feed means for urging the fastener assemblage toward the separation site, and wherein said antiback member includes a structure which may be moved by the user to deflect the antiback member and feed means out of the feed track, thereby to permit withdrawal of the fastener assemblage from the feed track.

15. A needle assembly as defined in claim 11 wherein the needle is metallic and the holder is plastic which is injection molded around said needle.

16. Apparatus for separating fasteners from a fastener assemblage and for dispensing plastic fasteners, comprising a tool body, and a needle assembly which may be easily secured to and removed from said tool body wherein the needle assembly defines in conjunction with the tool body at least the major portion of a feed track for channelling the fastener assemblage through said tool, wherein said needle assembly comprises a needle permanently encased in a holder, said needle assembly comprising a replaceable part of said apparatus.

17. Apparatus as defined in claim 16, wherein the said needle assembly and tool body jointly define a segment of said feed track which is substantially parallel to the longitudinal axis of the needle.

18. Apparatus as defined in claim 16 wherein the needle assembly comprises a hollow, slotted metal needle encased in an injection molded plastic holder.

* * * * *